US005195346A

United States Patent [19]

Braun et al.

[11] Patent Number: 5,195,346

[45] Date of Patent: Mar. 23, 1993

[54] ROLLING MILL STAND WITH ARRANGEMENTS FOR SUPPORTING AN UPPER WORK ROLL OF THE STAND

[75] Inventors: Martin Braun; Jürgen Armenat; Heinrich Röse, all of Kreuztal, Fed. Rep. of Germany

[73] Assignee: SMS Schloemann Siemag Aktiengesellschaft, Dusseldorf, Fed. Rep. of Germany

[21] Appl. No.: 783,564

[22] Filed: Oct. 28, 1991

[30] Foreign Application Priority Data

Oct. 29, 1990 [DE] Fed. Rep. of Germany ..... 4034436

[51] Int. Cl.[5] ..... B21B 31/08

[52] U.S. Cl. ..... 72/238; 72/245

[58] Field of Search ..... 72/237, 238, 239, 244, 72/245, 247

[56] References Cited

U.S. PATENT DOCUMENTS 4,967,582 11/1990 Bohenkamp ..... 72/245

FOREIGN PATENT DOCUMENTS 2326389 12/1974 Fed. Rep. of Germany ..... 72/238
0011566 3/1971 Japan ..... 72/238
0544484 1/1974 U.S.S.R. ..... 72/238
0576128 10/1977 U.S.S.R. ..... 72/238
0738702 6/1980 U.S.S.R. ..... 72/237
2118468 11/1983 United Kingdom ..... 72/238

*Primary Examiner*—Lowell A. Larson
*Assistant Examiner*—Thomas C. Schoeffler
*Attorney, Agent, or Firm*—Anderson Kill Olick & Oshinsky

[57] ABSTRACT

A rolling mill stand with work rolls which are supported in chocks, wherein the upper work roll can be raised from the lower work roll by balancing cylinders and wherein the upper work roll can be supported for a roll change on the balancing cylinders above the lower work roll in order to avoid contact of the bodies of the rolls. The chocks of one of the rolls include pivotable support levers which in a basic position thereof extend around sides of opposite chocks. The support levers can be pivoted into an effective position in which the free ends of the support levers rest on the bottom of grooves provided in the opposite chocks.

10 Claims, 3 Drawing Sheets

ROLLING MILL STAND WITH ARRANGEMENTS FOR SUPPORTING AN UPPER WORK ROLL OF THE STAND

BACKGROUND OF THE INVENTION

1. Field of the Invention

The present invention relates to a rolling mill stand with arrangements for the spaced-apart support of an upper work roll of the stand. Specifically, the invention relates to a rolling mill stand with work rolls which are supported in chocks, wherein the upper work roll can be raised from the lower work roll by means of balancing cylinders and wherein the upper work roll can be supported for a roll change on the balancing cylinders above the lower work roll in order to avoid contact of the bodies of the rolls, wherein the support is effected by mechanical means of the chocks.

2. Description of the Related Art

In sets of work rolls, it is known in the art to equip the chocks of the upper work rolls and the lower work rolls with projections and recesses, for example, pins and holes, so that during normal operation the projections engage more or less in the recesses; in order to carry out the disassembly, the upper work rolls are raised together with their chocks and are then axially displaced, so that the projections are moved out of the regions of the recesses and can be placed on portions of the chocks which are located at a higher lever, so that the bodies of the two work rolls of a set no longer contact each other and, thus, the surface properties of the roll bodies are not impaired by the contact.

However, it has been found that the time required by a roll change, which results in an undesirable idle period of the stand, is increased in a disadvantageous manner by the necessity of the axial displacement of the upper work rolls after the work roll has been raised. Another disadvantage is the fact that the structural length of the roll set to be exchanged is increased by the required additional axial displacements, so that the manipulation of the roll set is more difficult.

Rolling mill stands which are in use today often have additional possibilities of adjustment, in which the work rolls can be additionally displaced axially, relative to each other during the rolling operation, for example, in order to be able to place the ends of the bodies of work rolls above edges of the rolled material to change the effective crown or camber by means of a special shape or surface contour (CVC). In rolls of this type, the recesses must be extremely long, so that the relative axial displacement is not impaired during the operation; in addition, for the roll change, the rolls must be displaced even at a greater distance relative to each other.

SUMMARY OF THE INVENTION

Therefore, it is the object of the present invention to provide in a rolling mill stand of the above-described type a simple arrangement which makes it possible during a roll change to support the upper work roll at such a distance above the lower work roll that contact of the roll bodies and, thus, damage to the surfaces of the roll bodies are excluded. The arrangement should also be easy and simple to manipulate, so that additional time periods for placing the upper work roll on the lower work roll are not necessary or that these periods are very short.

In accordance with the present invention, in a rolling mill stand of the above-described type, the chocks of one of the rolls include pivotable support levers which in a basic position thereof extend around sides of opposite chocks. The support levers can be pivoted into an effective position in which the free ends of the support levers rest on the bottom of grooves provided in the opposite chocks.

The above-described arrangement of the pivotable support levers makes it possible that the rolls which during rolling are not effective are pivoted after the rolls have been raised into the grooves of the opposite chock in such a way that the load of the upper work roll and of the chocks thereof is absorbed in a safe and stable manner.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
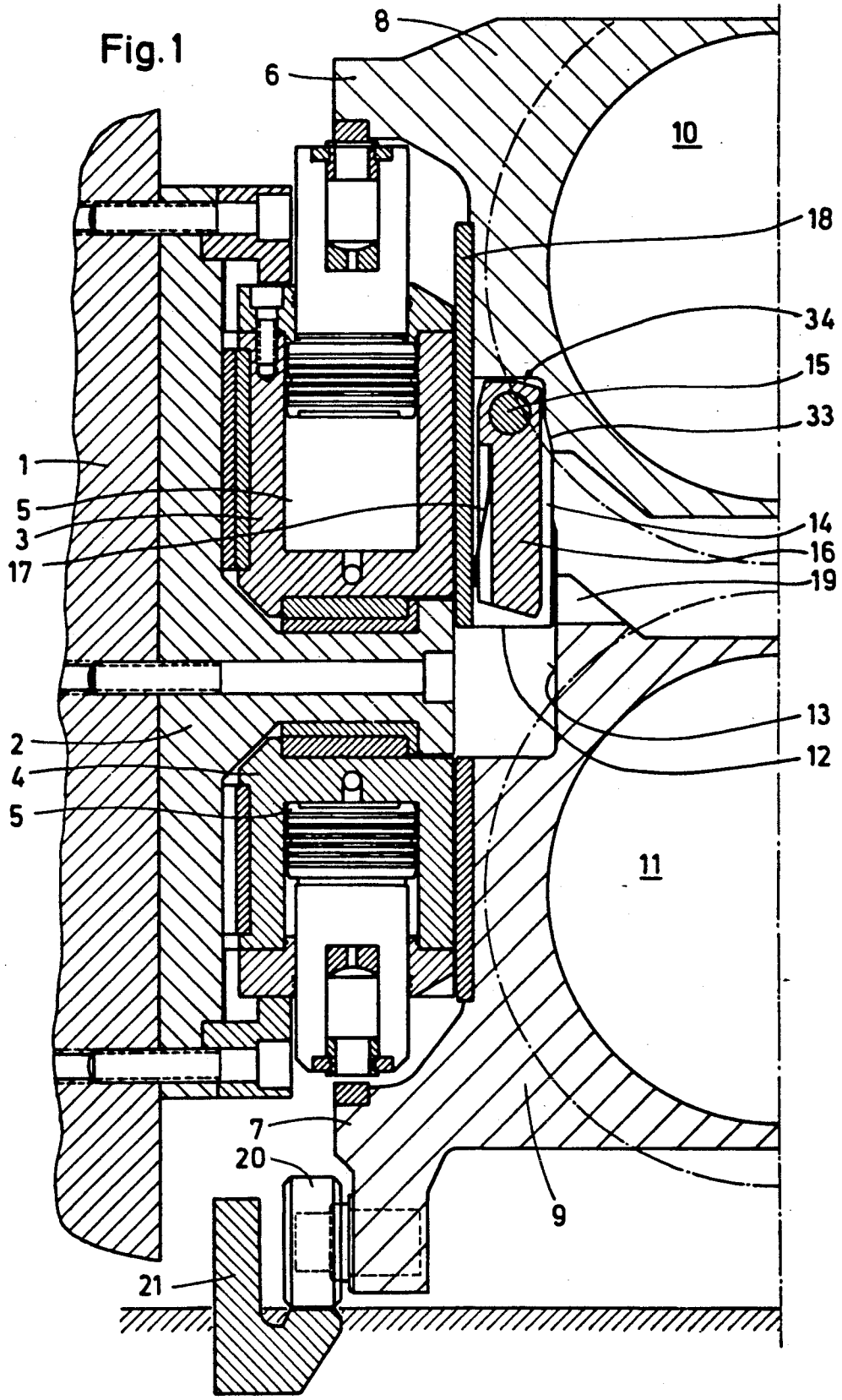
FIG. 1 is a partial sectional view of a housing and chocks of a rolling mill stand.

FIG. 1 of the drawing is a vertical sectional view extending perpendicularly to the axis of a housing 1 which is partially illustrated. The housing 1 has windows in which a stationary block 2 is mounted by means of screws. Movable blocks 3 and 4 are mounted in the stationary block 2 so as to be displaceable parallel to the axes of the rolls. The movable blocks 3 and 4 are each equipped with hydraulic bending cylinders 5 for bending the work rolls. The piston rods of these bending cylinders 5 engage behind projections 6, 7 of the chocks 8, 9 of the work rolls 10, 11.

The chocks 8 of the upper work roll 10 have attachments 12 which engage laterally around sides 13 of the chocks 9 of the lower work roll. The attachments 12 are each provided with a slot 14. Support levers 16 which are held by a swivel bolt 15 are pivotably arranged in the slot 14. The support levers 16, in turn, are at the rear thereof provided with a groove in which a spring 17 is mounted. In the illustrated embodiment, the spring 17 is a plate spring whose one end is connected to the support lever 16 and whose free end rests against a wear plate 18 of the chock 8. The upper end of the chock 9 of the lower work roll 11 is provided with a groove 19 for receiving the support lever 16.

The projections 7 of the chock 9 of the lower work roll 11 not only engage under the piston rods of the bending cylinders 5; the projections 7 also are equipped with a bolt which supports a roller 20 and makes it possible that the work rolls can be moved outwardly by means of a raisable rail 21.

Figure 2:
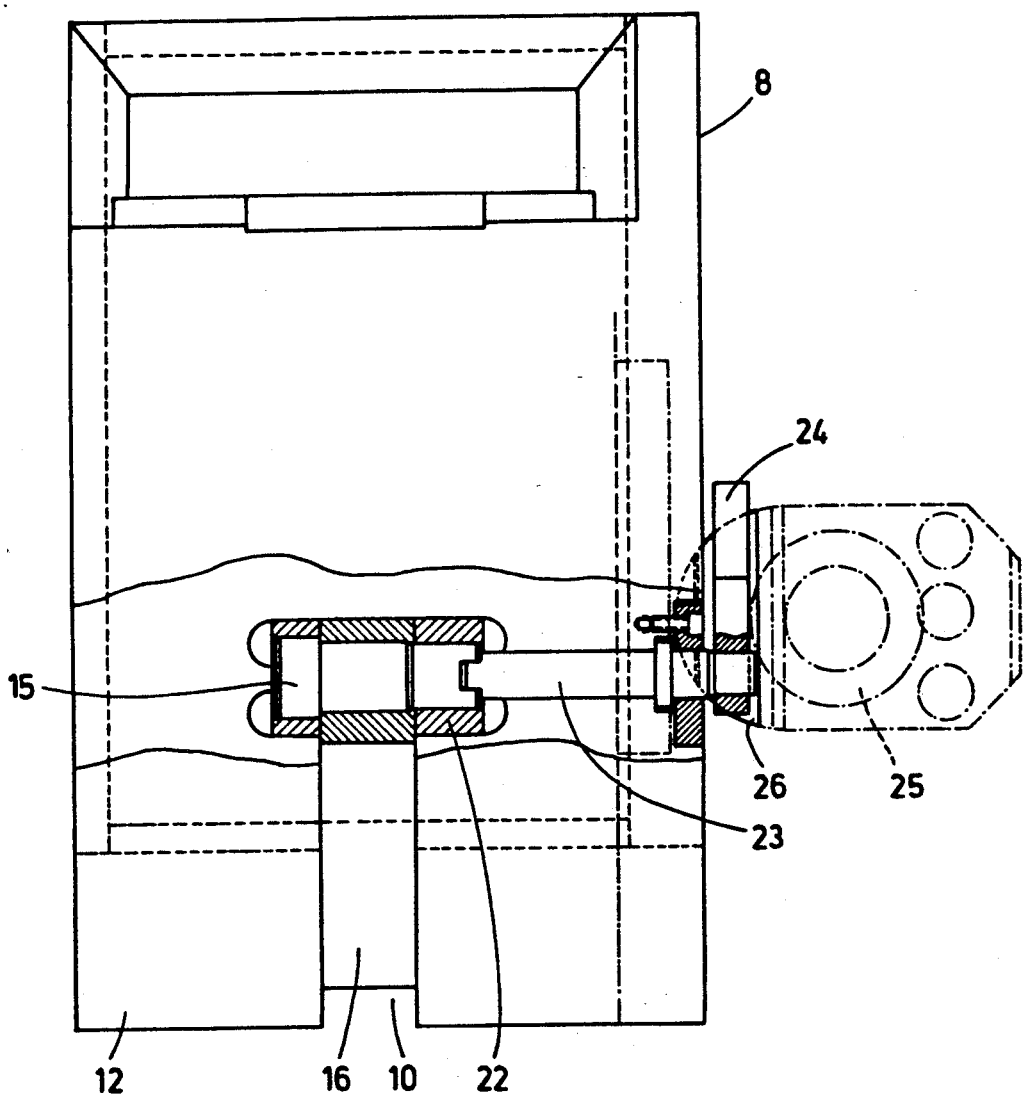
FIG. 2 is a top view of a chock shown partially in section parallel to its vertical axis.

FIG. 2 is a partially broken side view of a chock 8 of the upper work roll 10. The swivel bolt 15 is mounted with slight play in sleeves 22 which are illustrated in cross-section. Connected to the swivel bolt 15 is the support lever 16 which is pivotable within the slot 10 of the attachment 12. A shaft 23 engages in a positively locking manner in one of the ends of the swivel bolt 15. The shaft 23 is held by a plate which engages over a collar of the shaft 23. The free end of the shaft 23 is provided with an actuating lever 24 which rests against a locking member 26. The locking member 26 is arranged on the slidable block 3 and can be actuated by a locking cylinder 25.

Figure 3:
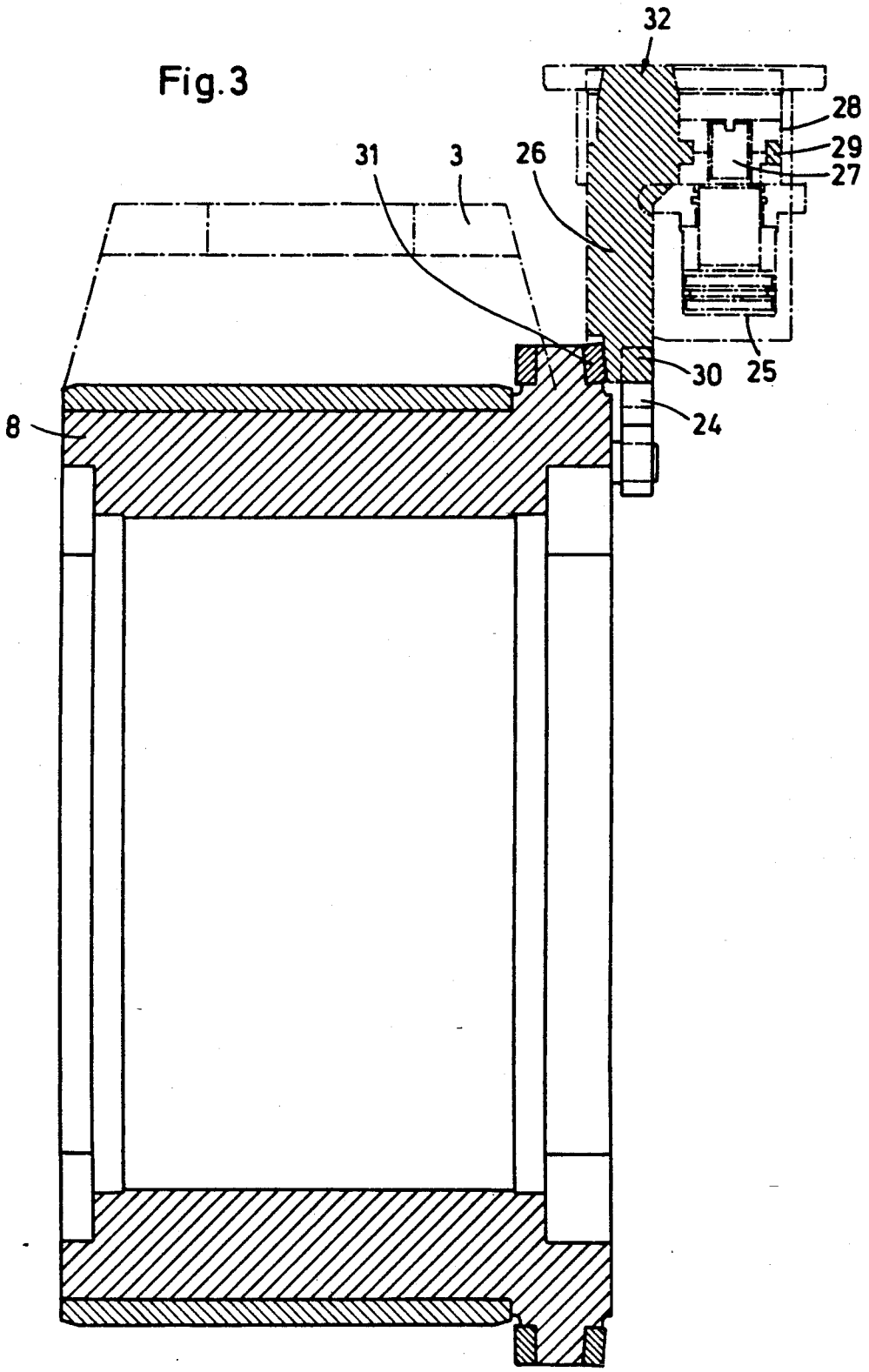
FIG. 3 is a horizontal sectional view of a chock and a locking mechanism thereof.

The partial vertical sectional view of FIG. 3 shows the shaft 27 of the locking cylinder 25 on which is attached by means of a nut 28 an annular projection 29 of the locking member 26. In the illustrated position of the retracted piston of the locking cylinder 25, an end 30 of the locking member 26 engages behind a shoulder member 31 of the chock 8 and thereby connects the movable block 3 with the chock 8, so that when the upper work roll 10 is axially displaced the chock 8 of the upper work roll 10 takes along the movable block 3.

For carrying out a roll change, initially the bending cylinders 5 which also serve for balancing purposes and act on the projections 6 of the upper chocks 8, raise the upper chocks 8 into the illustrated position. Since already previously displacement devices of the work rolls, not shown, have moved the work rolls into the axial center or zero position thereof, the springs 17 press the support levers 16 which are pivotable about the swivel bolts 15 into the groove 19 of the chocks 9 of the lower work rolls 11. As this happens, a portion of the shaft of the support lever 16 rests as a stop against the side surface 33 of the shoulder member 31 of the chock 8 acting as a stop, and, when the force applied by the bending cylinders 5 is reduced, the bottom of the slot 14 makes contact with a surface 34 of the head of the support lever 16, so that, because of the play of the swivel bolt 15 in the sleeve 22 receiving the bolt 15, the transmission of the load of the upper work roll 10 with chocks 8 takes place through this head surface 34 and the swivel bolt 15 is now subjected to shearing forces.

In order to facilitate the engagement of the support lever 16 in the groove 19, the sides of the groove 19 at the engagement side are inclined and widen conically and/or the border strips of the sides of the support lever 16 which are located in the front in pivoting direction narrow conically.

The pretensioning of the springs 17 is not sufficient for causing the support lever 16 to reach engagement in the groove 19. It is also necessary to release the actuating lever 24. In the illustrated embodiment, this is effected by actuating the locking cylinder 25. During rolling, the piston of the locking member 25 is retracted and the ends 30 of the locking member 26 engage over the shoulder members 31 of the chocks 8. Consequently, the locking members 26 connect the chocks 8 with the movable blocks 3.

When the work rolls 10 and 11 are moved into the symmetrical center or zero position thereof, the locking cylinder 25 can be actuated. Consequently, the projections 32 of the locking members 26 penetrate in recesses of the housing and, thus, lock the movable blocks 3 in a zero position thereof with the housing, so that the position cannot change during the subsequent procedure of moving out the set of rolls and an unlocking can occur after the exchange set of work rolls has been moved in. However, simultaneously with the release of the shoulder members 31 of the chocks 8, the actuating levers 24 of the support levers 16 are also released, so that the support levers 16 can now enter in the grooves 19 as a consequence of the pretensioning of the spring 17.

The above-described configuration not only makes it possible to absorb the weight of the upper work roll 10 with chocks 8, a simultaneous locking of the sets of work rolls in axial direction is achieved because of the fact that the support levers 16 enter the grooves 19 whose width is adjusted to the support levers 16 and because of the guidance of the support levers in the slots 14. The side surfaces 33 of the chocks 8 simultaneously ensure a stable support in relation to the transverse forces which may act on the set of rolls. Accordingly, the set of rolls can now be moved out after raising and securing the rail 21 and unloading the upper bending cylinder 5.

After a prepared exchange set of rolls has been moved in, the upper work roll 10 with chocks 8 is slightly raised by means of the upper bending cylinders 5 and, by retracting the locking cylinder, the connection between the movable blocks 3 and the housing is unlocked and the movable blocks 3 are simultaneously connected to the chocks 8. Subsequently, by swinging back the actuating lever 24 when the locking member 26 is actuated, the support lever 16 is raised out of the groove 19 and is pivoted back against the force of the springs 17 into the extreme position illustrated in FIG. 1, so that the initial pass can now be carried out after bending cylinders 5 have been subjected to a load which is appropriate for rolling.

The present invention is not limited to the illustrated embodiment. In particular, the actuation of the support lever 16 can be configured differently. For example, separate actuating devices may be provided for the support lever 16. In the case of double-acting drive devices, it is also possible to omit pretensioning by means of a spring. If the appropriate dimensions are provided, it is further possible to transmit the forces absorbed by the support lever through the swivel bolt 15. Of course, it is possible to construct the swivel bolt and the shaft controlling the swivel bolt as a single piece.

In all of the above-described cases, for carrying out a roll change, the upper work roll can be supported in a simple manner such that a distance is maintained to the lower work roll without requiring special axial displacements of the work rolls relative to each other. Simultaneously, the work rolls are not only maintained at a predetermined distance relative to each other, they are also secured one above the other in a symmetrical position.

While a specific embodiment of the invention has been shown and described in detail to illustrate the application of the inventive principle, it will be understood that the invention may be embodied otherwise without departing from such principles.

We claim:

1. A rolling mill stand, comprising:

an upper work roll;

a lower work roll, wherein said upper and lower work rolls are supported in chocks;

balancing cylinders for raising the upper work roll from the lower work roll;

mechanical means for supporting the upper work roll for a roll change on the balancing cylinders above the lower work roll for preventing contact of the rolls;

pivotable support levers included as part of one of said rolls, wherein each lever is movable between a basic position and an effective position and extends in the basic position thereof around sides of the chocks of the other of said rolls;

grooves defined by the chocks of the other of the rolls; and free ends on the support levers, wherein the free ends rest on bottoms of the grooves when the support levers are in the effective position.

2. The rolling mill stand of claim 1, further comprising:

springs mounted on swivel shafts for biasing the support levers into one of the basic position and the effective position; and actuating levers for acting on the swivel shafts.

3. The rolling mill stand of claim 2, wherein said swivel shafts of the support levers are mounted with play, and wherein each support lever further comprises a head with a contour, wherein a chock of one of the work rolls defines slots for receiving the support levers, wherein the slots define contours, wherein a load to be supported is absorbed by the contours of the support levers in connection with the contours of the slots.

4. The rolling mill stand of claim 3, wherein the contours of the support levers in connection with the contours of the slots define stops for limiting a pivoting range of the support levers.

5. The rolling mill stand of claim 3, wherein the support levers have sides, wherein the sides of the support levers in connection with the contours of the slots define stops for limiting a pivoting range of the support levers.

6. The rolling mill stand of claim 5, wherein each groove receiving a respective support lever has a width which only slightly exceeds a thickness of the respective support lever, and wherein the sides of the support levers conically narrow toward the grooves.

7. The rolling mill stand of claim 5, wherein each groove receiving a respective support lever has a width which only slightly exceeds a thickness of the respective support lever, and wherein each slot receiving a respective support lever conically widens in direction toward the respective support lever.

8. The rolling mill stand of claim 2, further comprising drive devices for the actuating levers.

9. The rolling mill stand of claim 2, further comprising:

locking members for locking the chocks; and control cams having a work range, the actuating levers engaging in the work range of the control cams.

10. The rolling mill stand of claim 2, further comprising:

locking members for locking movable blocks which support the balancing cylinders; and control cams having a work range, wherein the actuating levers engage in the work range of the control cams.

* * * * *